US010190283B2

(12) United States Patent
van Amelsfoort et al.

(10) Patent No.: US 10,190,283 B2
(45) Date of Patent: Jan. 29, 2019

(54) APPARATUS AND METHOD FOR COUPLING A WORK TOOL TO AN ARM ASSEMBLY OF A MACHINE

(71) Applicant: Caterpillar Work Tools B.V., s-Hertogenbosch (NL)

(72) Inventors: Edward van Amelsfoort, Tilburg (NL); Henricus J. Dings, Kerkdriel (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 0 days.

(21) Appl. No.: 15/352,174

(22) Filed: Nov. 15, 2016

(65) Prior Publication Data

US 2017/0145654 A1 May 25, 2017

(30) Foreign Application Priority Data

Nov. 24, 2015 (GB) ..... 1520732.7

(51) Int. Cl.
*E02F 3/36* (2006.01)
*E02F 3/32* (2006.01)

(52) U.S. Cl.
CPC ..... *E02F 3/3636* (2013.01); *E02F 3/32* (2013.01)

(58) Field of Classification Search
CPC ..... E02F 3/3636
See application file for complete search history.

(56) References Cited

U.S. PATENT DOCUMENTS 5,125,788 A * 6/1992 Stenger ..... E02F 3/3627 414/723
5,400,531 A 3/1995 Brown
5,546,683 A * 8/1996 Clark ..... E02F 3/3631 414/723
5,597,283 A 1/1997 Jones
5,692,855 A * 12/1997 Burton ..... E02F 3/3631 172/272
5,865,594 A * 2/1999 Kim ..... E02F 3/3631 414/723

(Continued)

FOREIGN PATENT DOCUMENTS

CA 2815032 10/2014
DE 4109783 9/1991

(Continued)

OTHER PUBLICATIONS

Search Report dated Jan. 11, 2016, issued in GB 1520732.7 (2 pages).

(Continued)

*Primary Examiner* — Gerald McClain

(57) ABSTRACT

An apparatus for coupling a work tool to an arm assembly of a machine includes a first plate and a second plate fixed to the work tool, the second plate being spaced apart from the first plate along a first direction. An external surface of the first plate defines a forward recess and an aft recess, and an external surface of the second plate defines a forward recess and an aft recess. A concavity of each of the forward recess of the first plate, the aft recess of the first plate, the forward recess of the second plate, and the aft recess of the second plate facing a second direction, the second direction being transverse to the first direction.

11 Claims, 8 Drawing Sheets

(56) References Cited

U.S. PATENT DOCUMENTS

| | | | | |
|---|---|---|---|---|
| 6,513,268 | B2 * | 2/2003 | Lee | E02F 3/3636 172/273 |
| 6,606,805 | B2 | 8/2003 | Kimble et al. | |
| 7,014,385 | B2 * | 3/2006 | Lim | E02F 3/3618 414/723 |
| 7,690,880 | B2 * | 4/2010 | Honeyman | E02F 3/3631 37/468 |
| 8,020,324 | B2 * | 9/2011 | Moser | E02F 3/3604 172/272 |
| 8,469,623 | B2 | 6/2013 | Luyendijk et al. | |
| 9,976,277 | B2 * | 5/2018 | van Amelsfoort | E02F 3/3618 |
| 2001/0051093 | A1 * | 12/2001 | Riccardi | E02F 3/3631 414/723 |
| 2003/0131505 | A1 | 7/2003 | Heiple | |
| 2003/0133779 | A1 | 7/2003 | Heiple | |
| 2004/0245002 | A1 | 12/2004 | Muroto | |
| 2006/0237201 | A1 | 10/2006 | Moriuchi | |
| 2007/0201973 | A1 | 8/2007 | McDermott et al. | |
| 2011/0280648 | A1 | 11/2011 | Malacrino et al. | |

FOREIGN PATENT DOCUMENTS

| | | |
|---|---|---|
| EP | 2824243 | 1/2015 |
| ES | 2304330 | 10/2008 |
| GB | 2169582 | 7/1986 |
| GB | 2522420 | 7/2015 |
| GB | 2522454 | 7/2015 |

OTHER PUBLICATIONS

Search Report dated Jan. 19, 2016, issued in GB 1520728.5 (1 page).

Search Report dated Jan. 19, 2016, issued in GB 1520735.0 (2 pages).

* cited by examiner

APPARATUS AND METHOD FOR COUPLING A WORK TOOL TO AN ARM ASSEMBLY OF A MACHINE

CLAIM FOR PRIORITY

This application claims benefit of priority of United Kingdom Patent Application No. GB 1520732.7, filed Nov. 24, 2015, which is incorporated herein by reference.

TECHNICAL FIELD

The current disclosure relates to engaging work tools to machines, and more particularly it relates to an apparatus and a method for assembling a work tool to an arm assembly of a machine.

BACKGROUND

Machines, such as, hydraulic excavators, hydraulic shovels, backhoe loaders and the like, are often required to perform different kinds of work on a work site. Therefore, different work tools, such as buckets, hammers, rippers, and grapples, may have to be engaged with an arm assembly (including, for example, sticks and booms) of the machine. It is known that the process of removing one work tool from the arm assembly and replacing the work tool with a different work tool may be a time consuming and difficult process. Quick couplers have been employed to enable quick engagement of the stick and the work tool and the quick couplers do, to an extent, reduce effort required for removing the work tool and replacing it. However, such quick couplers add weight to the stick end and build up the stick height/length. As a result, the machine's capabilities may be compromised.

For example, U.S. Pat. No. 7,014,385 B2 discloses an attachment coupling device for heavy machinery. The attachment coupling device is designed to releasably connect a variety of attachments to an arm and a push link of heavy machinery, such as hydraulic excavators. The attachment coupling device comprises a pair of mounting brackets fixedly secured to the attachment, each bracket having first and second hooks spaced apart with each other. Another major element of the coupling device is a coupler which includes, a fixed plate affixed to the arm and the push link, a pair of fixed coupling pins each protruding outwardly from the fixed plate for engagement with the first hook of each of the mounting brackets, a pair of movable coupling pins for movement between a retracted release position and an extended coupling position, wherein the respective one of the movable pins comes into engagement with the second hook of each of the mounting brackets, and an actuator for causing movement of the movable coupling pins.

SUMMARY OF THE DISCLOSURE

The present disclosure provides an apparatus for coupling a work tool to an arm assembly of a machine. The arm assembly includes at least one arm and the work tool includes at least one engagement means. The apparatus includes at least one coupling means adapted to engage with the at least one arm and the at least one engagement means. The at least one coupling means is adapted to move between an extended position, for engaging with the at least one engagement means for coupling the work tool to the arm assembly, and a retracted position, for disengaging from the at least one engagement means for separating the work tool from the arm assembly.

The present disclosure further provides a machine comprising the aforementioned apparatus. In a further embodiment, the present disclosure may further provide an arrangement comprising aforementioned apparatus, arm assembly and work tool.

The present disclosure further provides a method of coupling a work tool to an arm assembly of a machine. The arm assembly includes at least one arm and the work tool includes at least one engagement means. The method includes engaging at least one coupling means with the at least one arm, and the at least one engagement means. The method further includes moving the at least one coupling means to an extended position, wherein the at least one coupling means couples the work tool to the arm assembly in the extended position.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
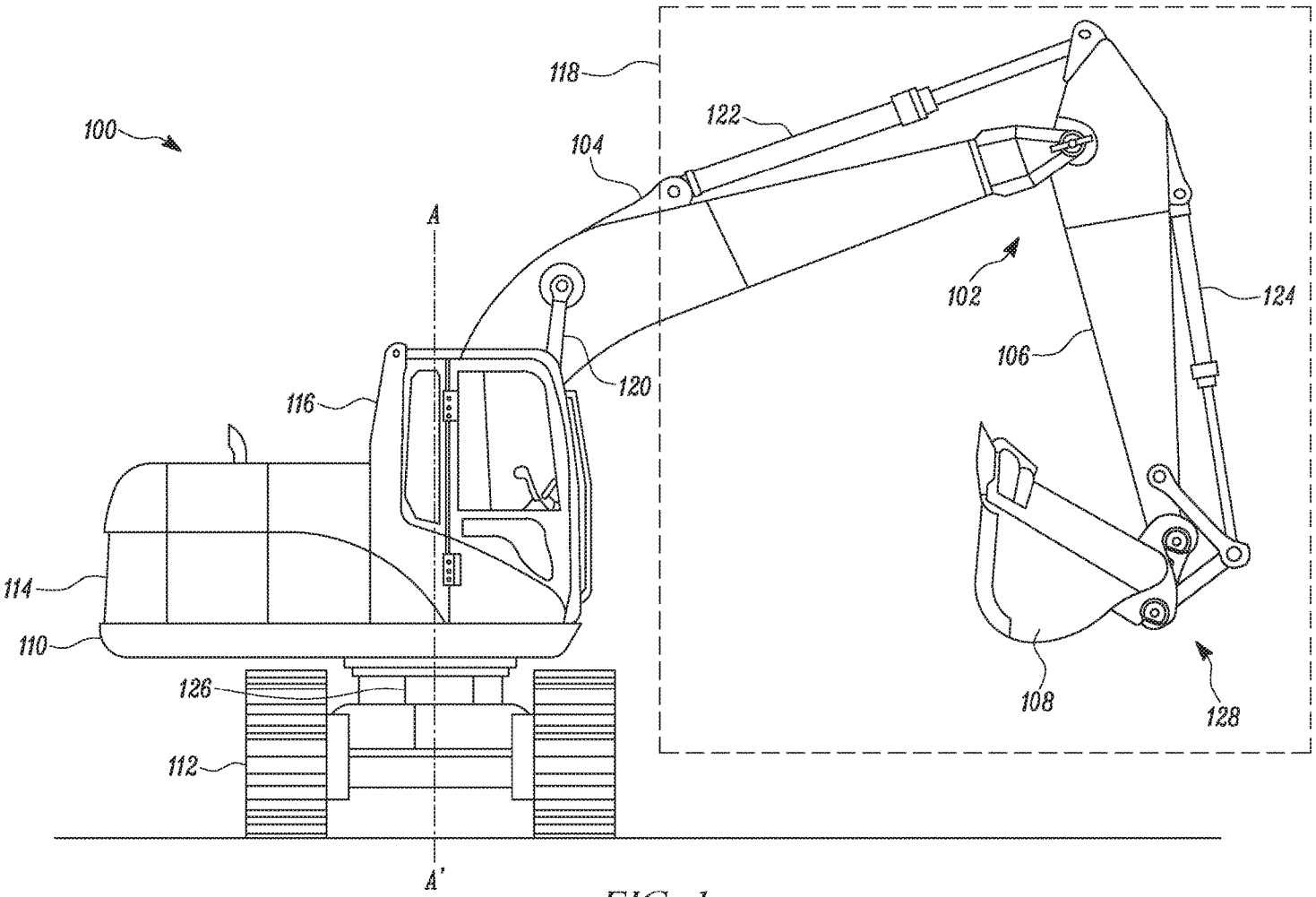
FIG. 1 illustrates a side view of a machine equipped with an arm assembly, according to an embodiment of the present disclosure.

FIG. 1 illustrates a side view of an exemplary machine 100 equipped with an arm assembly 102, according to an embodiment of the present disclosure. The machine 100 may be an excavator, a material handler, a long reach excavator, a foundation drill, a rock drill, a piling machine, a tunneling machine, or a front shovel. In the illustrated embodiment, the machine 100 is shown to be an excavator-type earth-moving or logging machine. Further, the arm assembly 102 includes linkages such as a boom 104, at least one arm, such as a first arm 106, and a work tool 108. The boom 104 may be pivotally connected to a chassis 110 of the machine 100, the first arm 106 may be pivotally connected to the boom 104, and the work tool 108 may be pivotally connected to the first arm 106.

The machine 100 may also include a drive unit 112, such as tracks for propelling the machine 100, a power source 114 to power the arm assembly 102 and the drive unit 112, and an operator cabin 116 for hosting user interface devices for controlling the arm assembly 102 and the drive unit 112. The power source 114 may embody an engine, such as a diesel engine, a gasoline engine, a gaseous fuel-powered engine, or any other type of combustion engine known in the art. The power source 114 may alternatively embody a non-combustion source of power such as a fuel cell, a power storage device, or another source known in the art. The power source 114 may produce a mechanical or electrical power output that may then be converted to hydraulic power for moving the arm assembly 102 and the work tool 108.

Further, an overall movement of the work tool 108 in a first vertical plane 118 (shown in FIG. 1) may be achieved in three parts, first by raising and lowering the boom 104 with respect to the chassis 110, second by moving the first arm 106 toward and outward with respect to the operator cabin 116, and third by rotating the work tool 108 relative to the first arm 106. The boom 104 may be raised and lowered by a pair of first hydraulic actuators 120. The first arm 106 may be moved toward and outward with respect to the operator cabin 116 by a second hydraulic actuator 122. In addition, a third hydraulic actuator 124 may be used to curl and uncurl the work tool 108 relative to the first arm 106. Furthermore, the chassis 110 and the arm assembly 102 may be rotated about a vertical axis V (Shown in FIG. 1) by a fourth hydraulic actuator 126, such as a hydraulic motor, with respect to the drive unit 112.

According to an aspect of the present disclosure, the machine 100 includes a coupling apparatus 128 (also referred to as "apparatus 128") for coupling the work tool 108 to the arm assembly 102, to aid in the curling and uncurling movements of the work tool 108 with respect to the first arm 106. The various components of the coupling apparatus 128 are described in details in the following paragraphs.

Figure 2:
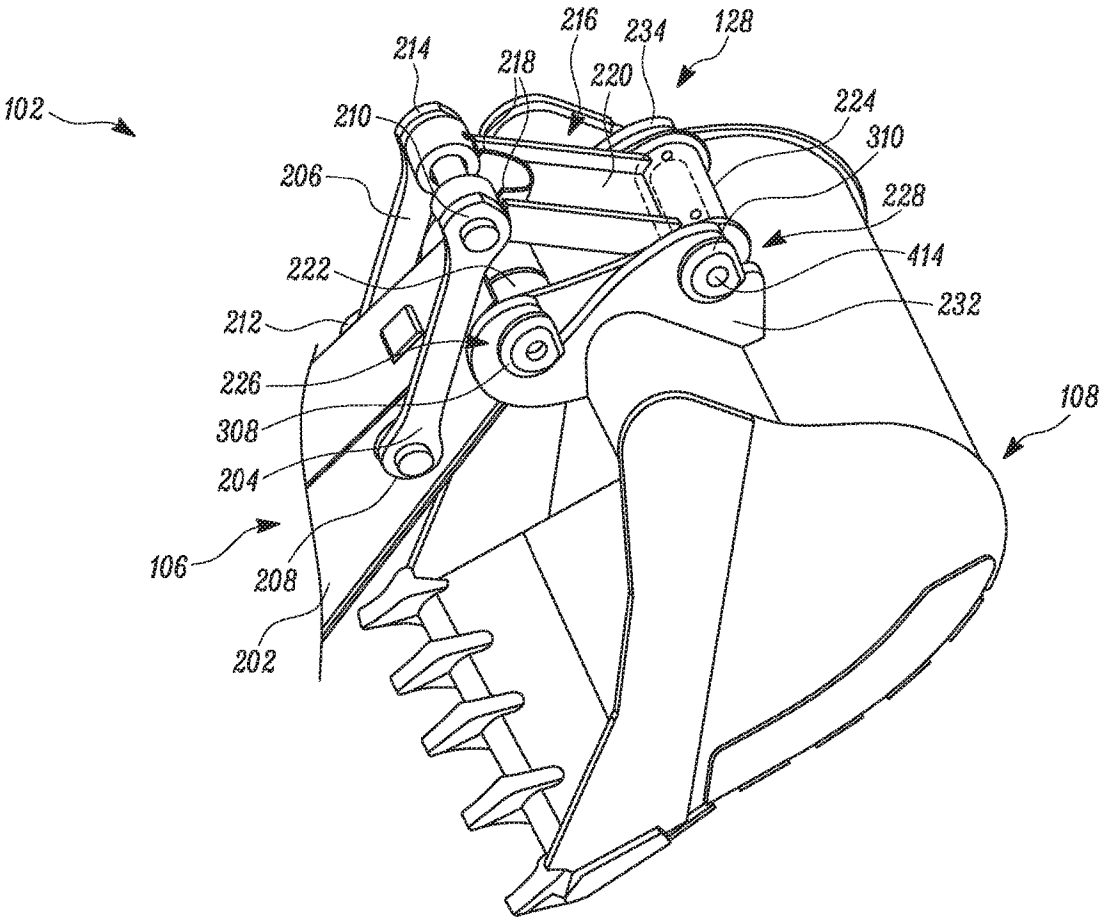
FIG. 2 illustrates the arm assembly equipped with a coupling apparatus for assembling a work tool to the arm assembly in a retracted position, according to an embodiment of the present disclosure.

FIG. 2 illustrates the arm assembly 102 and the coupling apparatus 128 operably coupled to the arm assembly 102, in accordance with an embodiment of the present disclosure. As described earlier, the arm assembly 102 includes the first arm 106, which extends longitudinally away from the operator cabin 116. In one example and for the purpose of this description, the first arm 106 is considered to have a rectangular cross-section, and accordingly the first arm 106 has a first side 202 and a second side (not shown) opposite to the first side 202. Further, the arm assembly 102 includes a first connecting arm 204 and a second connecting arm 206. The first connecting arm 204 has a first end 208 and a second end 210. The first end 208 of the first connecting arm 204 is adapted to be attached to the first side 202 of the first arm 106 and the second end 210 of the first connecting arm 204 is disposed distant from the surface of the first arm 106. Similarly, the second connecting arm 206 has a first end 212 and a second end 214. The first end 212 of the second connecting arm 206 is adapted to be attached to the second side of the first arm 106 and the second end 214 of the second connecting arm 206 is disposed distant from the surface of the first arm 106. In one example, the first connecting arm 204 and the second connecting arm 206 may be positioned inclined with a certain angle with respect to the first arm 106.

The arm assembly 102 may further include a second arm 216 having a first end 218 and a second end 220. The first end 218 of the second arm 216 is attached to the second end 210 of the first connecting arm 204 and the second end 214 of the second connecting arm 206. Further, the second end 220 of the second arm 216 is disposed distant from the first end 218, such that the second arm 216 is inclined to the first connecting arm 204 and the second connecting arm 206. In an embodiment of the present disclosure, the first arm 106 may be a stick end of the arm assembly 102, and the second arm 216 may be a push bar.

For the purpose of coupling the coupling apparatus 128 to the arm assembly 102, the arm assembly 102 comprises at least one connecting means, such as a first connecting means 222 and a second connecting means 224. In said implementation, the first connecting means 222 is located at an end portion of the first arm 106, as shown in FIG. 2, and the second connecting means 224 is located at the second end 220 of the second arm 216. The first connecting means 222 and the second connecting means 224 may be, in an example, provided as hollow cylindrical components with internal passageways.

Figure 3:
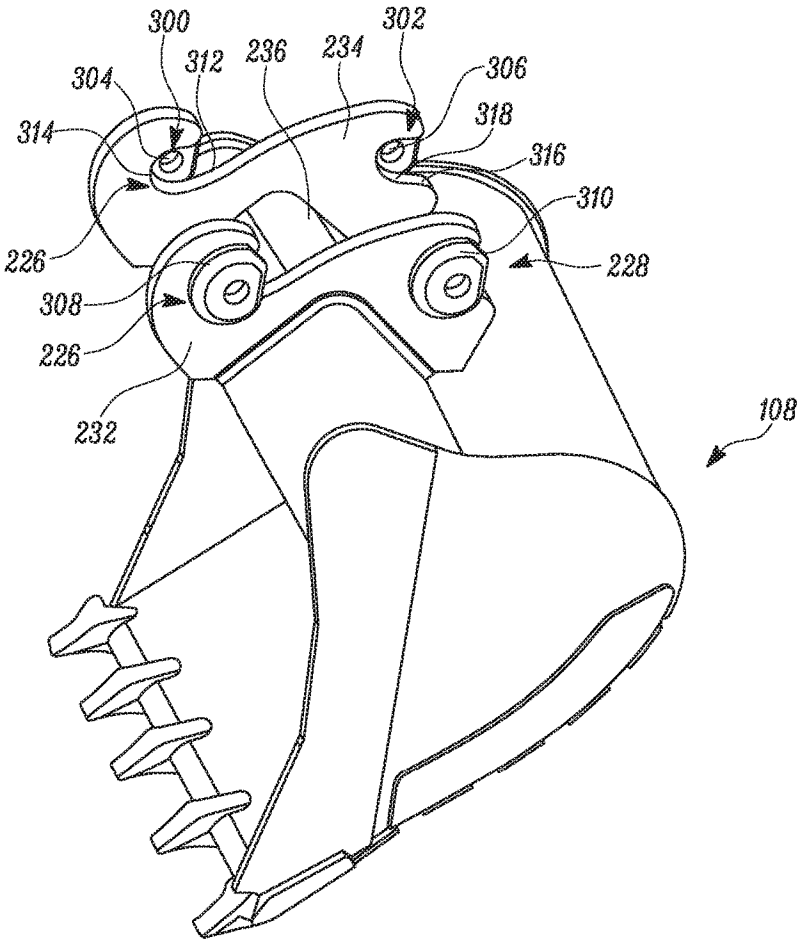
FIG. 3 illustrates a work tool, according to an embodiment of the present disclosure.

Referring now to FIG. 3, which illustrates the work tool 108. The work tool 108 includes at least one engagement means, such as a first engagement means 226 and a second engagement means 228. The first engagement means 226 and the second engagement means 228 are adapted to aid in coupling the work tool 108 to the arm assembly 102. Specifically, the first engagement means 226 and the second engagement means 228 are adapted to aid in coupling the work tool 108 to the first connecting means 222 and the second connecting means 224 of the arm assembly 102.

The first engagement means 226 and the second engagement means 228 are formed on at least one plate, such as a first plate 232 and a second plate 234. The first plate 232 and the second plate 234 (also alternatively referred to as first side member 232 and the second side member 234, respectively) are separated by, and are connected to, a base member 236. The base member 236 may be adapted to attach the first plate 232 and the second plate 234 to the work tool 108, as illustrated in FIG. 3. In one example, the base member 236 may be welded to the work tool 108. In another example, the first side member 232 and the second side member 234 may be formed as integral parts of the work tool 108. Further, the first side member 232 and the second side member 234 may be attached to the work tool 108 in various other ways, as would be known to a person skilled in the art, albeit with few variations to the structure of the first side member 232, the second side member 234, and the work tool 108.

As illustrated in FIG. 3, the at least one engagement means, such as the first engagement means 226 and the second engagement means 228 includes at least one recess. Specifically, the first engagement means 226 may include a first recess 300 in the form of a cut out on the at least one plate. Likewise, the second engagement means 228 may include a second recess 302 in the form of a cut out on the at least one plate. Further, at least one covering member, such as a first covering member 308 and a second covering member 310 is adapted to abut against respective outer surfaces of the first side member 232 and the second side member 234 to partially cover the respective cut outs. Furthermore, as illustrated, a first aperture 304 extends from the first recess 300 and through the first covering member 308, and a second aperture 306 extends from the second recess 302 and through the second covering member 310.

The first recess 300 includes a first neck portion 312 and a first receiving portion 314 connected to the first neck portion 312. The first neck portion 312 may be formed as a guiding portion with respect to the first receiving portion 314, as illustrated in FIG. 3. Likewise, the second recess 302 includes a second neck portion 316 and a second receiving portion 318 connected to the second neck portion 316. The second neck portion 316 may be formed as a guiding portion with respect to the second receiving portion 318, as illustrated. Further, the first receiving portion 314 and the second receiving portion 318 may have a semi-circular profile.

The first neck portion 312 and the first receiving portion 314 of the first recess 300 facilitate the coupling of the work tool 108 to the arm assembly 102. Further, the second neck portion 316 and the second receiving portion 318 of the second recess 302 also facilitate in coupling of the work tool 108 to the arm assembly 102. At least one of the first aperture 304 of the first recess 300 and the second aperture 306 of the second recess 302 facilitating locking of the work tool 108 to the arm assembly 102 upon engagement of the work tool 108 to the arm assembly 102. In one embodiment of the present disclosure, the first receiving portion 314 of the first engagement means 226 and the second receiving portion 318 of the second engagement means 228 are directed towards a same direction, for example towards or opposite a direction of a material receiving opening of the work tool 108. In an embodiment of the present disclosure, the first engagement means 226 and the second engagement means 228 are substantially identical in shape, size, and construction.

Figure 4:
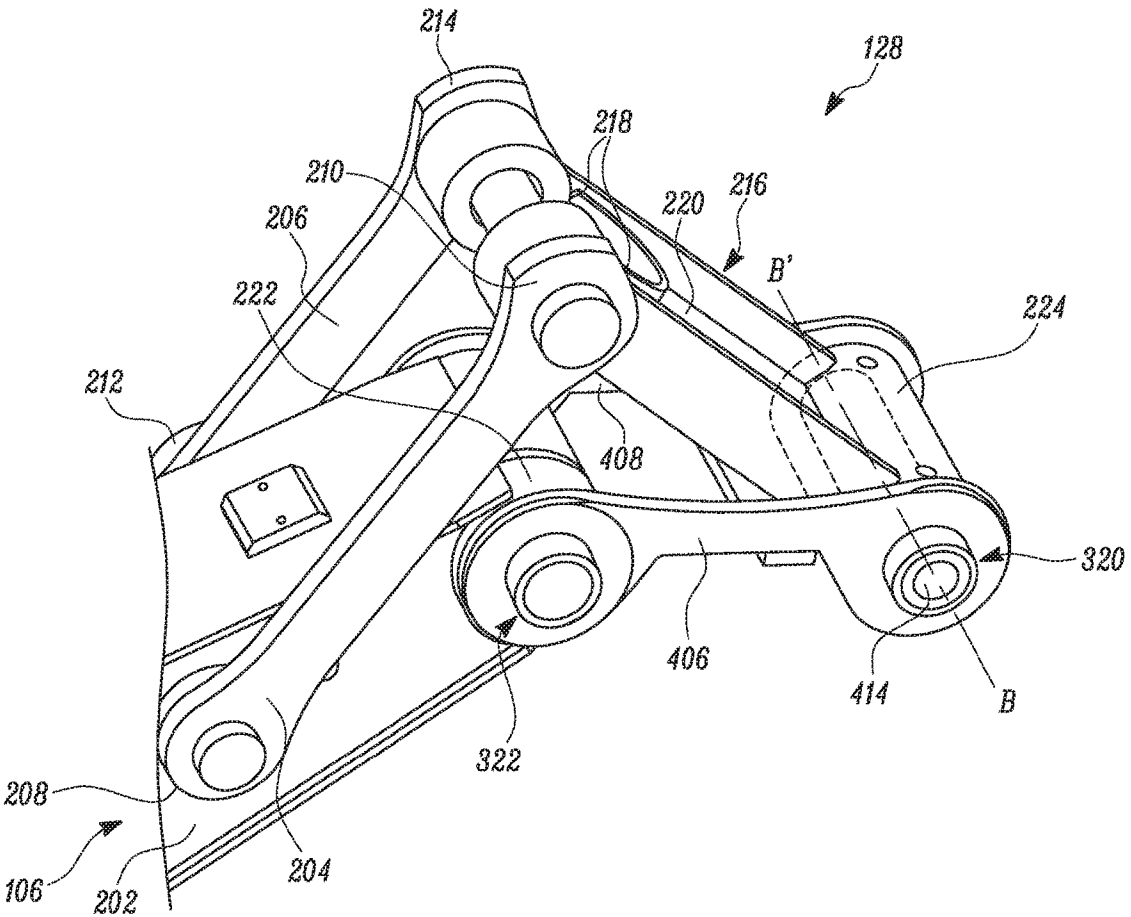
FIG. 4 illustrates the coupling apparatus, according to an embodiment of the present disclosure.

Referring now to FIG. 4, the coupling apparatus 128 includes at least one coupling means, such as a first coupling means 320 and a second coupling means 322. The at least one coupling means is adapted to engage with the at least one, arm such as the first arm 106 or the second arm 216. Further, the at least one coupling means may be adapted to engage with the at least one engagement means. Specifically, as per the present embodiment, the first coupling means 320 is adapted to engage with the second arm 216 through the second connecting means 224 of the arm assembly 102, and the second coupling means 322 is adapted to engage with the first arm 106 through the first connecting means 222 of the arm assembly 102.

Figure 5:
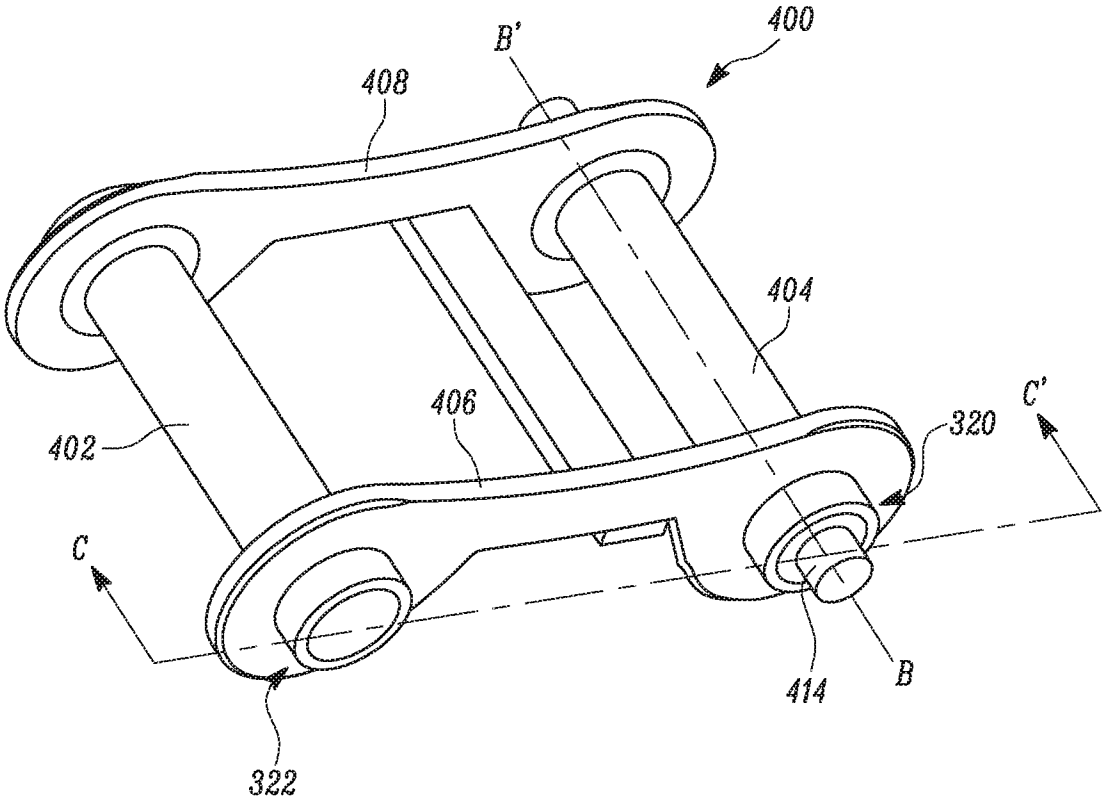
FIG. 5 illustrates a frame of the coupling apparatus, according to an embodiment of the present disclosure.
Figure 6:
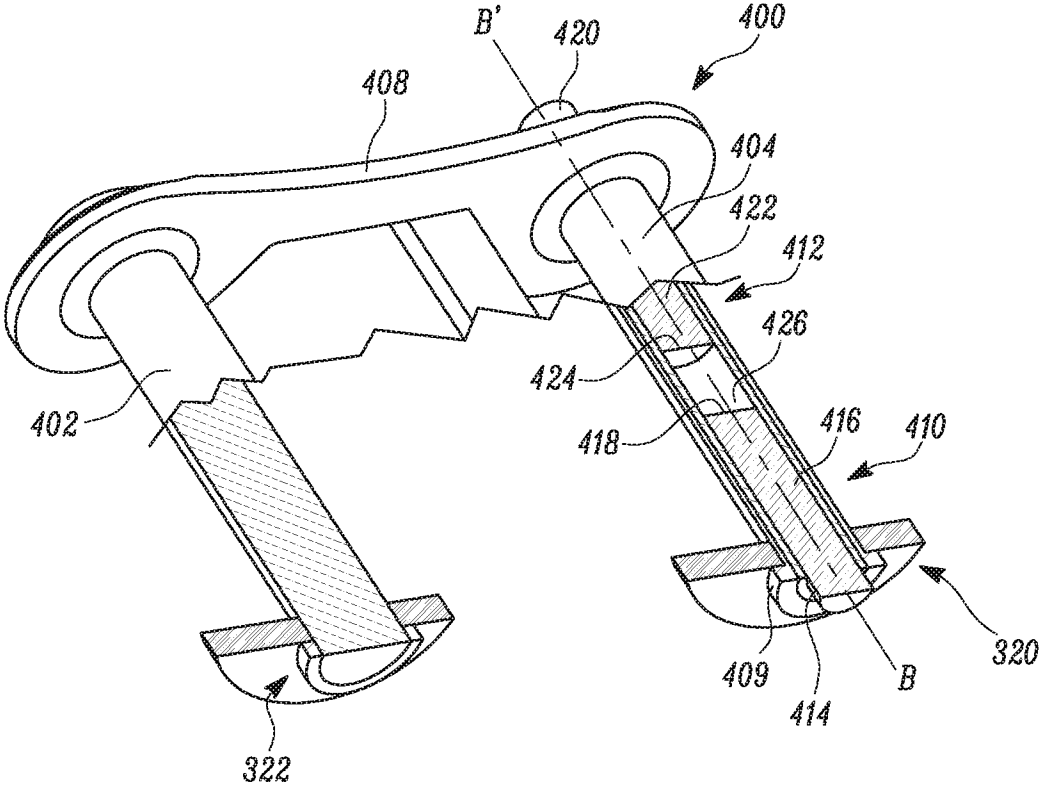
FIG. 6 illustrates a sectional view of the frame of the coupling apparatus, according to an embodiment of the present disclosure.

In one implementation, the coupling apparatus 128 can further include a frame 400, as shown in FIGS. 5 and 6. The frame 400 is adapted to be engaged with the first arm 106 and the second arm 216, and, upon engagement, prevent relative movement between the first arm 106 and the second arm 216. The frame 400 is engaged with the first connecting means 222 and the second connecting means 224 of the arm assembly 102. For the purpose, the frame 400 includes a first mounting means 402, a second mounting means 404, and at least one support, such as a support 406 and a support 408. The supports 406 and 408 may be in the form of a plate, connected between the first mounting means 402 and the second mounting means 404. Once the first mounting means 402 is connected to the first connecting means 222 of the first arm 106 and the second mounting means 404 is connected to the second arm 216, the relative movement between the first arm 106 and the second arm 216 is prevented. The length of the support 406 is predetermined based on a distance between the first connecting means 222 and the second connecting means 224. Further, the first mounting means 402 and the second mounting means 404 may be formed in any suitable shape and design so that to be engaged and coupled with the work tool 108 and the arm assembly 102. For example, the first mounting means 402 and the second mounting means 404 may be shaped as bars or blocks or a combination thereof.

In the disclosed embodiment, the first coupling means 320 and the second coupling means 322 are provided as cylindrical protruding bodies on the supports 406 and 408, respectively. The first coupling means 320 and the second coupling means 322 are adapted to be engaged with the first engagement means 226 and the second engagement means 228, respectively. Therefore, the profile of the first coupling means 320 may be corresponding to the profile of the first neck portion 312 and the first receiving portion 314 of the first recess 300 of the first engagement means 226. Likewise, the profile of the second coupling means 322 may be corresponding to the second neck portion 316 and the second receiving portion 318 of the second recess 302 of the second engagement means 228. In alternative embodiments, the first coupling means 320 and the second coupling means 322 may have any other suitable shape and profile, such as spherical or cuboidal projections from the supports 406 and 408.

Figure 7:
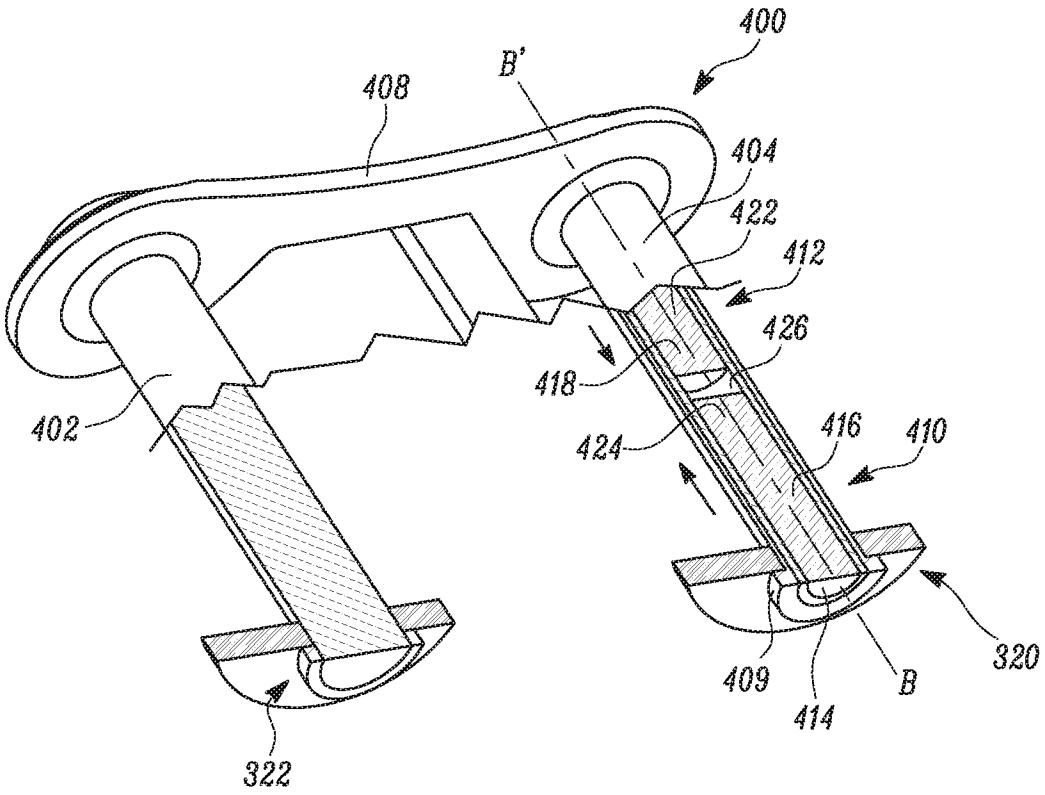
FIG. 7 illustrates another sectional view of the frame of the coupling apparatus, according to an embodiment of the present disclosure.

Referring now to FIGS. 6 and 7 which illustrate sectional views of the frame 400 taken along a section line C-C' shown in FIG. 5, at least one of the first coupling means 320 and the second coupling means 322 includes at least one pin. The at least one pin may be movable along an axis B-B' between its extended and retracted position. Specifically, the first coupling means 320 includes at least one body 409 containing at least one pin, such as a first pin 410 and a second pin 412. In an embodiment, the first pin 410 includes a first end portion 414, an elongated cylindrical body portion 416 extending from the first end portion 414 and a second end portion 418 opposite to the first end portion 414. Likewise, the second pin 412 includes a first end portion 420, an elongated cylindrical body portion 422 extending from the first end portion 420 and a second end portion 424 opposite to the first end portion 420. The second end portion 424 of the second pin 412 is positioned towards the second end portion 418 of the first pin 410. The first end portion 414 of the first pin 410 and the first end portion 420 of the second pin 412 are positioned opposite to each other on opposite supports 406 and 408, respectively.

The first pin 410 and second pin 412 have cylindrical profile and are adapted to slidably move with respect to each other along the axis B-B.' During such sliding movement, the first pin 410 and the second pin 412 may either move away form one another, or towards one another along the axis B-B.' Once the first pin 410 has moved substantially away from the second pin 412, it is referred to as the extended position of the coupling means, such as the first coupling means 320 (shown in FIG. 6). In the extended position, the first pin 410 and second pin 412 may engage with the second recess 302 of the second engagement means 228, to lock the work tool 108 with the arm assembly 102 (shown in FIG. 2). Likewise, a position in which the first pin 410 and the second pin 412 has moved towards each other in an inward direction, is referred to as the retracted position of the coupling means such as the first coupling means 320 (shown in FIG. 7). In the retracted position, the first pin 410 and second pin 412 may slide out of the second recess 302 of the second engagement means 228, to unlock the work tool 108 from the arm assembly 102.

In an embodiment, such movement of the first pin member 410 and the second pin 412 is powered by pressurized hydraulic fluid which may be supplied to a space 426 defined by the second end portion 424 and the second end portion 418, therebetween. In alternative embodiments, such movement of the first pin member 410 and the second pin 412 may be powered by any other suitable means, such as pneumatic power source. A biasing means, such as at least one spring, may be connected between the first and second pins 410, 412 to bias them towards the retracted position.

Referring again to FIG. 2 which illustrate the arm assembly 102 and the coupling apparatus 128 operably coupled to the arm assembly 102, FIG. 3 which illustrates the work tool 108, and FIG. 5 which illustrates the frame 400, in accordance with an embodiment of the present disclosure. The first coupling means 320 is also adapted to engage with the second engagement means 228, and the and the second coupling means 322 is adapted to engage with the first engagement means 226, of the work tool 108. Thereafter, movement of the first pin 410 and the second pin 412, to the extended position thereof, locks the first coupling means 320 with the second engagement means 228.

Various embodiments disclosed herein are to be taken in the illustrative and explanatory sense, and should in no way be construed as limiting of the present disclosure.

INDUSTRIAL APPLICABILITY

Figure 8:
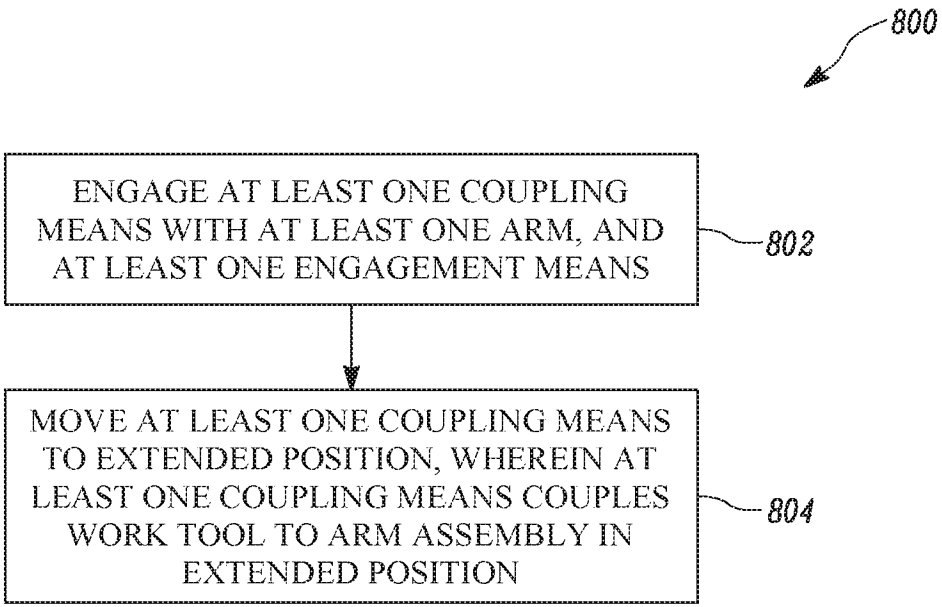
FIG. 8 is a flowchart of a method of coupling the tool engagement to the arm assembly, according to an embodiment of the present disclosure.

The present disclosure provides the coupling apparatus 128 for assembling the work tool 108 with the arm assembly 102 of the machine 100. The present disclosure further provides a method 800 for coupling the work tool 108 with the arm assembly 102. FIG. 8 shows a flowchart of the method 800, according to an embodiment of the present disclosure. Further, the method 800 may be implemented in any suitable hardware, such that the hardware employed can perform the steps of the method 800 readily and on a real-time basis. For the convenience in description, various steps of the method 800 will be described in conjunction with the preceding figures of the present disclosure.

Referring to FIG. 8, at step 802, the method 800 includes engaging the at least one coupling means 320, 322 with the at least one arm 106, 216 of the arm assembly 102. In one example embodiment, the arm assembly 102 may include the first connecting arm 204 and the second connecting arm 206 attached to the sides of the first arm 106 of the arm assembly 102. Further, the coupling apparatus 128 may include the first connecting means 222 and the second connecting means 224 adapted to engage with the at least one arm 204, 208. In one example implementation, the arm assembly 102 may include the first connecting means 222 and the second connecting means 224 adapted to receive the first mounting means 402 and the second mounting means 404 therein, respectively. Further, the first coupling means 320 may be engaged with the second engagement means 228, and the second coupling means 322 may be engaged with the first engagement means 226.

In order engaging the second coupling means 322 with the first engagement means 226, end portion of the second coupling means 322 may be inserted into the first recess 300 through the first neck portion 312 to the first receiving portion 314. The engagement of the second coupling means 322 with the first engagement means 226 is such that an angular movement of the work tool 108 with respect to he arm assembly 102 is allowed. Likewise, in order to engage the first coupling means 320 with the second engagement means 228, end portion of the first coupling means 320 may be inserted into the second recess 302 through the second neck portion 316 to the second receiving portion 318.

At step 804, the method 800 includes moving at least one coupling means 320, 322, to an extended position, wherein the at least one coupling means 320, 322, couples the work tool 108 to the arm assembly 102 in the extended position. In one example, the first coupling means 320 includes the first pin 410 and the second pin 412. The first pin 410 and the second pin 412 may be moved away from each other, i.e. the first coupling means 320 may be moved to the extended position. In such an extended position of the first coupling means 320, the first end portion 414 of the first pin 410 and the first end portion 420 of the second pin 212 engage with the second aperture 306.

Therefore, as it would be understood to the person skilled in the art, the coupling apparatus 128 of the present disclosure provides an easy and efficient assembling of the work tool 108 to the arm assembly 102. Since the coupling or the assembling of the work tool 108 and the arm assembly 102 is assisted by a simple the first coupling means 320 having the first pin 210 and the second pin 212, the process of coupling can be performed in short duration of time. Further, owing to the presence of such coupling means having the first pin and the second pin, the coupling apparatus 128 can be replaced or coupled to the arm assembly 102 at any instant of time. Furthermore, since the coupling or the assembling of the work tool 108 and the arm assembly 102 may be carried out by first coupling means 320, overall weight and length of the arm assembly 102 remains substantially same, and therefore capabilities of the machine 100 remain uncompromised. Furthermore, the work tool 108 can be connected to the coupling apparatus 128 in two different orientations (i.e. the opening of the work tool 108 facing towards or away from the operator cabin 116) by virtue of the first and second engagement means 226, 228 being substantially identical.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An apparatus for coupling a work tool to an arm assembly of a machine, the arm assembly comprising at least one arm, the apparatus comprising:

first engagement means including a first plate fixed to the work tool, an external surface of the first plate spanning a thickness of the first plate defining a forward recess and an aft recess;

second engagement means including a second plate fixed to the work tool, the second plate being spaced apart from the first plate along a first direction, an external surface of the second plate spanning a thickness of the second plate defining a forward recess and an aft recess, a concavity of each of the forward recess of the first plate, the aft recess of the first plate, the forward recess of the second plate, and the aft recess of the second plate facing a second direction, the second direction being transverse to the first direction;

a first covering member disposed on the first plate and a second covering member disposed on the second plate, an external surface of the first covering member at least partly defining the forward recess of the first plate, an external surface of the second covering member at least partly defining the forward recess of the second plate, an internal surface of the first covering member defining an aperture through the first covering member, an internal surface of the second covering member defining an aperture through the second covering member;

a third covering member disposed on the first plate and a fourth covering member disposed on the second plate, an external surface of the third covering member at least partly defining the aft recess of the first plate, an external surface of the fourth covering member at least partly defining the aft recess of the second plate, an internal surface of the third covering member defining an aperture through the third covering member, an internal surface of the fourth covering member defining an aperture through the fourth covering member; and a first pin that is configured to engage with the at least one arm and the first engagement means, wherein the first pin is configured to move between an extended position, for engaging with the first engagement means for coupling the work tool to the arm assembly, and a retracted position, for disengaging from the first engagement means for separating the work tool from the arm assembly, and wherein the first plate and the second plate are disposed between the first covering member and the second covering member along the first direction.

2. The apparatus of claim 1, further comprising a frame including a forward body, the first pin being disposed within an internal surface of the forward body, the first pin being free to translate relative to the forward body between the retracted position and the extended position along a longitudinal axis of the internal surface of the forward body, the forward body being removably engaged with the forward recess of the first plate and the forward recess of the second plate, the first pin being engaged with the aperture through the first covering member when the first pin is located in the extended position relative to the forward body, the first pin being disengaged from the aperture through the first covering member when the first pin is located in the retracted position relative to the forward body.

3. The apparatus of claim 2, further comprising a second pin disposed within the internal surface of the forward body, the second pin being free to translate relative to the forward body between a retracted position and an extended position along the longitudinal axis of the of the internal surface of the forward body, the second pin being engaged with the aperture through the second covering member when the first pin is located in the extended position relative to the forward body, the second pin being disengaged from the aperture through the second covering member when the first pin is located in the retracted position relative to the forward body.

4. The apparatus of claim 3, wherein the internal surface of the forward body, an end of the first pin, and an end of the second pin at least partly define a hydraulic space within the forward body, each of the first pin and the second pin being configured to translate away from one another, from the retracted position to the extended position, respectively, in response to increasing a hydraulic pressure within the hydraulic space.

5. The apparatus of claim 2, wherein the internal surface of the forward body and an end of the first pin at least partly define a hydraulic space within the forward body, the first pin being configured to translate from the retracted position to the extended position in response to increasing hydraulic pressure within the hydraulic space.

6. A machine, comprising:

an arm assembly including at least one arm;

a work tool; and an apparatus configured to couple the work tool to the arm assembly, the apparatus comprising:

first engagement means including a first plate fixed to the work tool, an external surface of the first plate spanning a thickness of the first plate defining a forward recess and an aft recess;

second engagement means including a second plate fixed to the work tool, the second plate being spaced apart from the first plate along a first direction, an external surface of the second plate spanning a thickness of the second plate defining a forward recess and an aft recess;

a concavity of each of the forward recess of the first plate, the aft recess of the first plate, the forward recess of the second plate, and the aft recess of the second plate facing a second direction, the second direction being transverse to the first direction;

a frame coupled to the at least one arm, the work tool being coupled to the at least one arm via engagement of the frame with the forward recess of the first plate, the aft recess of the first plate, the forward recess of the second plate, and the aft recess of the second plate;

a first covering member disposed on the first plate and a second covering member disposed on the second plate, an external surface of the first covering member at least partly defining the forward recess of the first plate, an external surface of the second covering member at least partly defining the forward recess of the second plate, an internal surface of the first covering member defining an aperture through the first covering member, an internal surface of the second covering member defining an aperture through the second covering member; and a pin that is configured to engage with the at least one arm and the first engagement means, wherein the pin is configured to move between an extended position, for engaging with the first engagement means for coupling the work tool to the arm assembly, and a retracted position, for disengaging from the first engagement means for separating the work tool from the arm assembly, wherein the first plate and the second plate are disposed between the first covering member and the second covering member along the first direction, and wherein the frame includes a forward body, the pin being disposed within an internal surface of the forward body, the pin being free to translate relative to the forward body between a retracted position and an extended position along a longitudinal axis of the internal surface of the forward body, the forward body being removably engaged with the forward recess of the first plate and the forward recess of the second plate, the pin being engaged with the aperture through the first covering member when the pin is located in the extended position relative to the forward body, the pin being disengaged from the aperture through the first covering member when the pin is located in the retracted position relative to the forward body.

7. A method for coupling a work tool to an arm assembly of a machine, the arm assembly comprising at least one arm, the machine comprising a frame coupled to the at least one arm;

first engagement means including a first plate fixed to the work tool, an external surface of the first plate spanning a thickness of the first plate defining a forward recess and an aft recess;

second engagement means including a second plate fixed to the work tool, the second plate being spaced apart from the first plate along a first direction, an external surface of the second plate spanning a thickness of the second plate defining a forward recess and an aft recess, a concavity of each of the forward recess of the first plate, the aft recess of the first plate, the forward recess of the second plate, and the aft recess of the second plate facing a second direction, the second direction being transverse to the first direction;

a first covering member disposed on the first plate, the first covering member at least partly defining the forward recess of the first plate, an internal surface of the first covering member defining an aperture through the first covering member;

a second covering member disposed on the second plate, the second covering member at least partly defining the forward recess of the second plate, an internal surface of the second covering member defining an aperture through the second covering member, the first plate and the second plate being disposed between the first covering member and the second covering member along the first direction; and a first pin and a second pin disposed within an internal surface of a forward body, the first pin being configured to engage with the at least one arm and the first engagement means, the method comprising:

engaging the forward body of the frame with the forward recess of the first plate and the forward recess of the second plate by translating the frame relative to the work tool along the second direction;

engaging the first pin with the first engagement means by extending the first pin from a retracted position to an extended position, thereby coupling the work tool to the arm assembly;

engaging the first pin with the aperture through the first covering member by translating the first pin from the retracted position to the extended position along a longitudinal direction of the internal surface of the forward body; and engaging the second pin with the aperture through the second covering member by translating the second pin from a retracted position to an extended position along the longitudinal direction of the internal surface of the forward body.

8. The method of claim 7, further comprising engaging an aft body of the frame with the aft recess of the first plate and the aft recess of the second plate by translating the frame relative to the work tool along the second direction.

9. The method of claim 8, wherein the engaging the aft body of the frame with the aft recess of the first plate and the aft recess of the second plate occurs simultaneously with the engaging the forward body of the frame with the forward recess of the first plate and the forward recess of the second plate.

10. The method of claim 7, wherein the first pin is located in the retracted position during the engaging the forward body of the frame with the forward recess of the first plate and the forward recess of the second plate.

11. The method of claim 7, further comprising increasing a hydraulic pressure in a hydraulic space defined at least partly by the internal surface of the forward body, and end of the first pin, and an end of the second pin, the increasing the hydraulic pressure causing each of the first pin and the second pin to translate from the retracted position to the extended position, respectively.

* * * * *